US006739949B2

(12) United States Patent
Becksvoort et al.

(10) Patent No.: US 6,739,949 B2
(45) Date of Patent: May 25, 2004

(54) ADJUSTABLE TOOL BODY WITH FLUID ACTUATION

(75) Inventors: Mark Lee Becksvoort, Hamilton, MI (US); Jason Wayne McEachran, Indianapolis, IN (US); Benjamin Muril Sipe, Geneva, IN (US)

(73) Assignee: Micromatic Operations, Inc., Holland, MI (US)

( * ) Notice: Subject to any disclaimer, the term of this patent is extended or adjusted under 35 U.S.C. 154(b) by 0 days.

(21) Appl. No.: 10/193,767

(22) Filed: Jul. 10, 2002

(65) Prior Publication Data

US 2003/0162485 A1 Aug. 28, 2003

Related U.S. Application Data

(60) Provisional application No. 60/360,158, filed on Feb. 26, 2002.

(51) Int. Cl.[7] ..... B24B 1/00; B24B 9/02

(52) U.S. Cl. ..... 451/28; 451/51; 451/61; 451/470; 451/478; 451/481

(58) Field of Search ..... 451/51, 52, 61, 451/470, 472, 476, 478, 481, 484, 485, 28

(56) References Cited

U.S. PATENT DOCUMENTS

| | | | | | |
|---|---|---|---|---|---|
| 2,213,027 | A | * | 8/1940 | Indge | 451/478 |
| 2,309,485 | A | * | 1/1943 | Wallace | 451/481 |
| 2,445,277 | A | * | 7/1948 | Mitchell | 451/478 |
| 2,631,414 | A | * | 3/1953 | Muehling | 451/151 |
| 2,741,071 | A | * | 4/1956 | Calvert | 451/150 |
| 2,787,865 | A | | 4/1957 | Gross | |
| 3,619,956 | A | * | 11/1971 | Gehring | 451/481 |
| 3,707,810 | A | * | 1/1973 | Grosseau | 451/478 |
| 4,075,794 | A | | 2/1978 | Blaylock | |
| 4,655,007 | A | * | 4/1987 | Graft et al. | 451/478 |
| 5,800,252 | A | | 9/1998 | Hyatt | 451/61 |
| 5,957,766 | A | | 9/1999 | Kalokhe et al. | 451/470 |

* cited by examiner

*Primary Examiner*—Timothy V. Eley
(74) *Attorney, Agent, or Firm*—Perman & Green, LLP

(57) ABSTRACT

The application describes a honing tool for use with a CNC machine. A fluid actuator provides the mechanism for causing radial adjustment of abrasive elements. The actuator consists of a piston and cylinder assembly mounted within the tool and powered by the through the tool cooling fluid of the CNC machine.

9 Claims, 5 Drawing Sheets

ADJUSTABLE TOOL BODY WITH FLUID ACTUATION

This application claims the benefit of Provisional Application No. 60/360,158, filed Feb. 26, 2002.

BACKGROUND OF THE INVENTION

Machines for boring and finishing cylindrical holes, such as engine cylinder bores, use a tool having abrasive strips mounted on a cylindrical body. As these tools wear, they are generally adjusted radially outward to compensate for the depletion of the abrasive surface. The wear compensating adjustment mechanism forms part of the tool body and comes in many shapes and sizes, for example the tool shown and described in U.S. Pat. No. 4,075,794. These tools consist of a mandrel which connects to the machine spindle at one end and is constructed with an abrasive head at the other. A connecting rod connects to an adjustment mechanism within the abrasive head to bias the abrasive elements radially outward against the work piece. The adjustment can be accomplished automatically as shown in the '794 patent or manually as shown in the reference Gross, U.S. Pat. No. 2,787,865.

The particular tools, shown in the above referenced patents, are used in honing machines for the construction of precision bores, such as piston cylinders in automotive engines, transmission pinion gears, and similar applications. In the past, such machines have been dedicated to specific tasks in association with particular production runs. With the onset of modern manufacturing concepts such as Just in Time Manufacturing, lean manufacturing, and other inventory reduction methods, there is a need to apply flexible machining systems to the tasks that were previously performed by dedicated machinery. Flexible machine systems generally employ computer numerically controlled (CNC) equipment capable of performing multiple varied operations on multiple workpieces. It is a purpose of this invention to provide a honing tool for use with CNC machinery.

A common feature of CNC machines is the use of through the tool coolant dispersion for lubricating and cooling the abrasives during use. It is another purpose of this invention to utilize the cooling fluid of CNC machines to provide actuation of the abrasive stone adjustment.

One attempt to utilize coolant fluid to actuate the adjustment of abrasive elements is shown in U.S. Pat. No. 5,800,252. In this system a revamped tool is constructed which provides a supply of pressurized liquid down the length of the mandrel to the underside of the abrasive elements. This design requires a specially designed fluid supply and tool. It is a purpose of this invention to provide a honing tool for CNC machines which can be simply retrofitted to provide fluid actuation of the abrasive elements.

SUMMARY OF THE INVENTION

A tool is constructed for a CNC machine station to perform a honing operation as part of a flexible machining system. The tool is an assembly of a tool body which holds the abrasive elements, a mandrel which supports the tool body, and a coupling which connects the tool to the CNC machine as is well known. Commonly the abrasive elements are positioned in axially extending slots positioned circumferentially about the periphery of the tool body. The abrasive elements engage a wedge shaped cam that is designed to convert an axial force into a radial force to move the abrasive elements radially. The abrasive elements are spring biased radially inward to provide both extension and retraction of the abrasive elements. The radial force is generally exerted by the motion of a shaft extending axially through the mandrel to engage the cam surfaces.

According to the system of this application, a closed pressure chamber is constructed at the spindle end of the mandrel. A piston is attached to the upper end of the adjustment shaft and mounted for movement within the chamber. The piston and axial shaft comprise the adjustment actuator assembly for the tool. The piston is spring biased towards the spindle end of the chamber. A supply of pressurized fluid or air is supplied to the chamber to force the piston to move along the axis of the mandrel against the force of the spring. The piston and chamber are designed to provide a continuous bias at the tool holders urging the abrasive elements radially outward. The piston chamber is designed to accept the pressure of liquid or gas from a pump or a regulator could be inserted in to the supply channel to control the pressure. The fluid supply is preferably coolant fluid, and will be explained as coolant in this document, is already available at the spindle of the CNC machine.

DESCRIPTION OF THE DRAWING

The invention is described in more detail below with reference to the attached drawing in which.

DESCRIPTION OF THE PREFERRED EMBODIMENT

Figure 4:
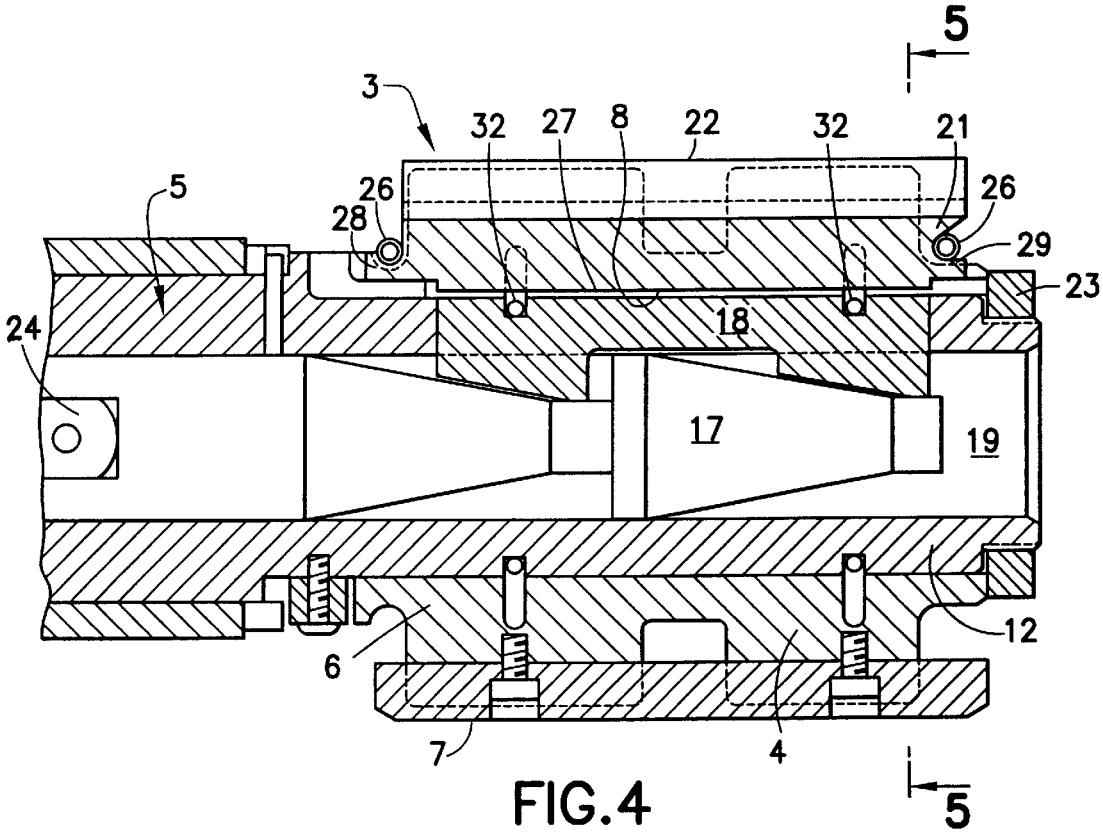
FIG.4 PRIOR ART
FIG. 4 is a cut away view of a mandrel and tool body assembly showing an example of the internal parts of an expander mechanism.
Figure 5:
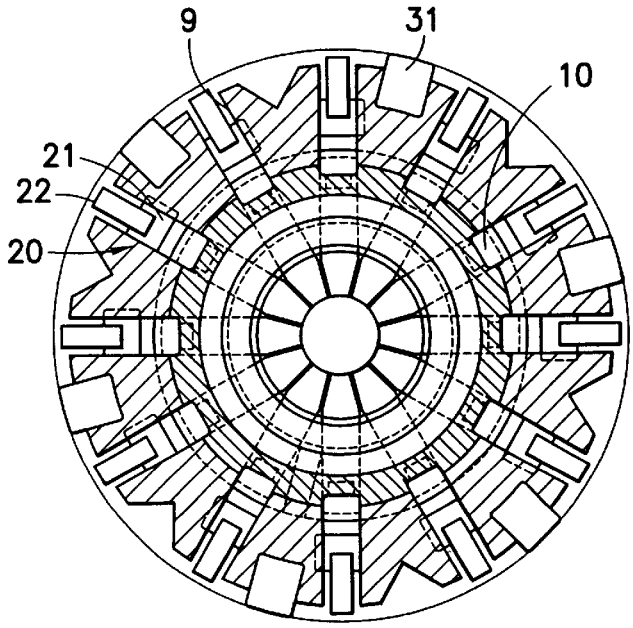
FIG.5 PRIOR ART
FIG. 5 is an end view of the mandrel and tool body assembly at section lines 4—4.
Figure 6:
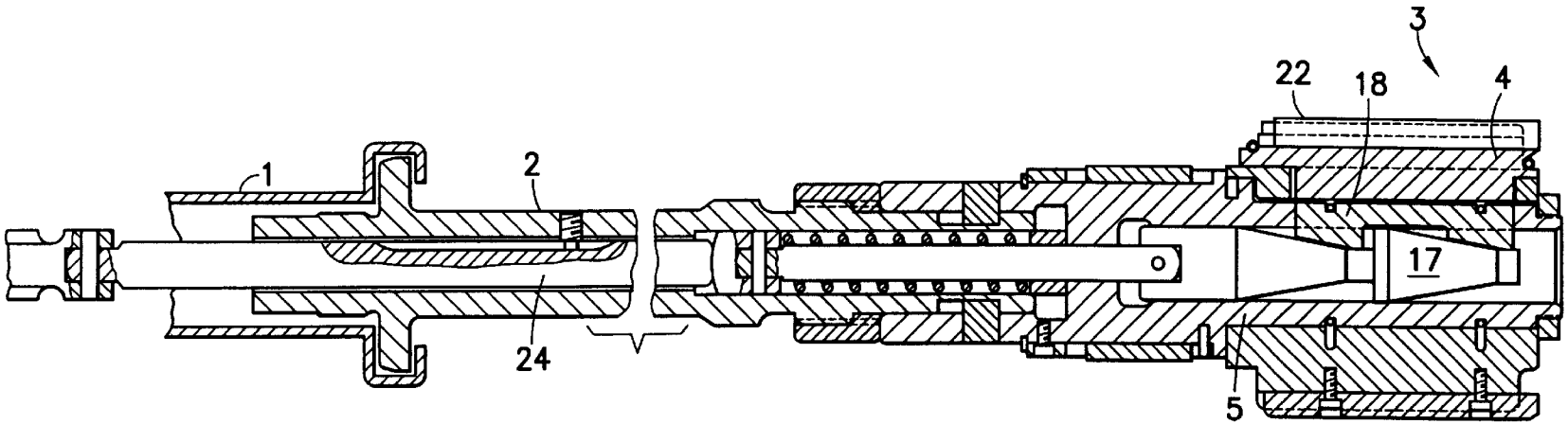
FIG.6 PRIOR ART
FIG. 6 is a cut away view of the entire tool assembly from tip to spindle of the prior art.

A tool mechanism generally representative of the art is shown in FIGS. 4–6 and is constructed for installation on spindle 1 of a honing machine. Such a tool is described in U.S. Pat. No. 5,957,766, which issued on Sep. 28, 1999 to an assignee common to this application. The disclosure of the '766 patent is incorporated herein by reference. The tool of the '766 patent is shown as an example of an expansion adjustment mechanism. In this example, the tool body is removable from the mandrel, but this feature does not form part of this invention, as the adjustment actuator of the subject invention is adaptable to other tool configurations, fixed, adjustable or otherwise.

The illustrated tool consists of an elongated support shaft 2, which connects the machine spindle 1 to the tool. A mandrel 5 is a generally cylindrical element, attached to the distal end 3 of support shaft 2, which encloses an adjustment mechanism and other parts of the tool. Mandrel 5 is operatively connected to shaft 2 for rotation. A tool body 4 is mounted at the distal end 3 of the mandrel 5 and contains the abrasive elements 22.

As shown in FIGS. 4–6, tool body 4 is constructed as a shell having an outer periphery 7, an inner end 6, and an internal axial bore 8. Channels 9 are formed in the outer periphery 7 and extend axially to receive an abrasive assembly 20. The abrasive assembly 20 consists of a holder 21 and an abrasive block 22. The abrasive holder 21 is constructed with a bottom surface 27 for engagement with the expander element 18, described below. Holder 21 is held in place by elastic springs 26, as shown in FIG. 4. O-rings 26 engage projections 28 and 29 on either end of the holder 21. Additional channels 30 extend axially on the body 4 to receive guide members 31.

Elongated slots 10 are constructed at the base of the channel 9 which communicate with the internal bore 8 to provide access to the abrasive holder 21 from within. Inner end 6 contains a hexagonal recess to receive a mating drive surface on the mandrel 5 for transmission of drive torque from mandrel 5 to tool body 4. As previously stated the removable feature of the tool body 4 of the illustrated tool is not instumental to this invention and tool body 4 could be fixed to the mandrel, as is well known in the art, nevertheless the adjustment mechanisms are operationally similar and equally adaptable to use the fluid adjustment apparatus of this invention.

The distal end 3 of mandrel 5 is shown in FIGS. 4–6 and has cylindrical housing 12 sized to fit into the bore 8 of tool body 4. Housing 12 encloses the tip portion of the expander mechanism, identified by elements 17 and 18 shown in FIG. 3. The cam element 18 is held in place by elastic springs 32.

The housing 12, forms part of mandrel 5, and is constructed with an inner chamber 19 into which the expander mechanism extends. Housing 12 is constructed with slots 16 through which the expander element 18 extends for operative engagement with the bottom surface 27 of holder 21. This engagement is accomplished through the aligned slots 10 in tool body 4 and slots 16 in mandrel housing 12. The outer end of mandrel 5 has a threaded portion 25 to receive the threaded end cap 23, which serves to secure the tool body 4 on the mandrel 5.

As shown in FIG. 5, the expander cam 17 is mounted at the tip end of an adjustment rod 24, which extends longitudinally within the support shaft 2 and connects with appropriate operating mechanisms within the spindle 1. The adjustment rod 24, when actuated, pushes downward causing cam 17 to move axially. Cam 17 exerts a radial force on expander element 18, which is in contact with the surface 27 of holder 21. Axial movement of the adjustment rod 24 will, therefore, move the abrasive assembly 20 outward to compensate for wear.

The above description illustrates the general operation of an expansion mechanism used in many types of tools. In the prior art, adjustment rod 24 is mechanically connected to a control mechanism located in the machine spindle. In the mechanism of this invention, as shown in FIGS. 1–3, the adjustment rod 24 is connected through a fluid medium to its actuation control.

Figure 1:
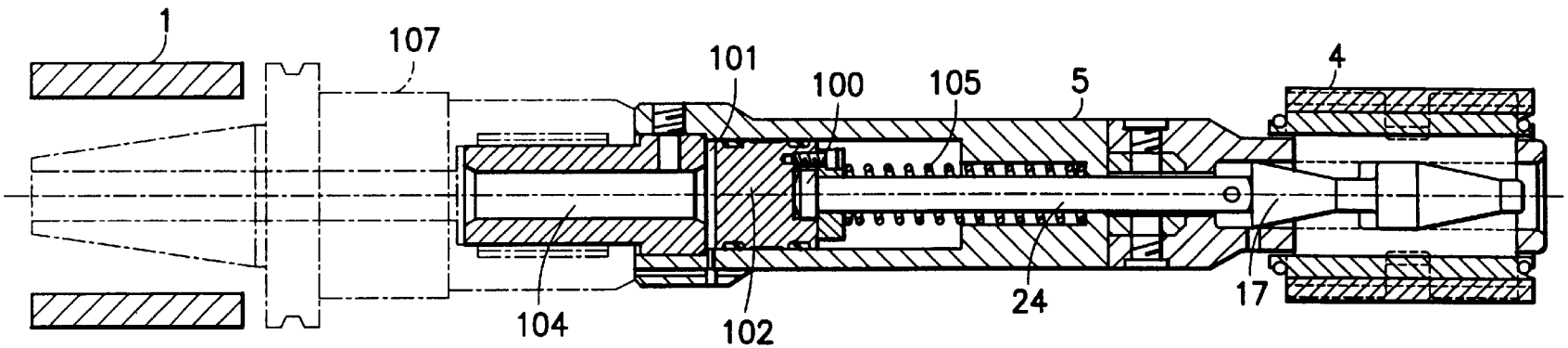
FIG. 1 is a side view of the tool of this invention, with the housing of the mandrel cut away to show the fluid adjustment mechanism of this invention.
Figure 2:
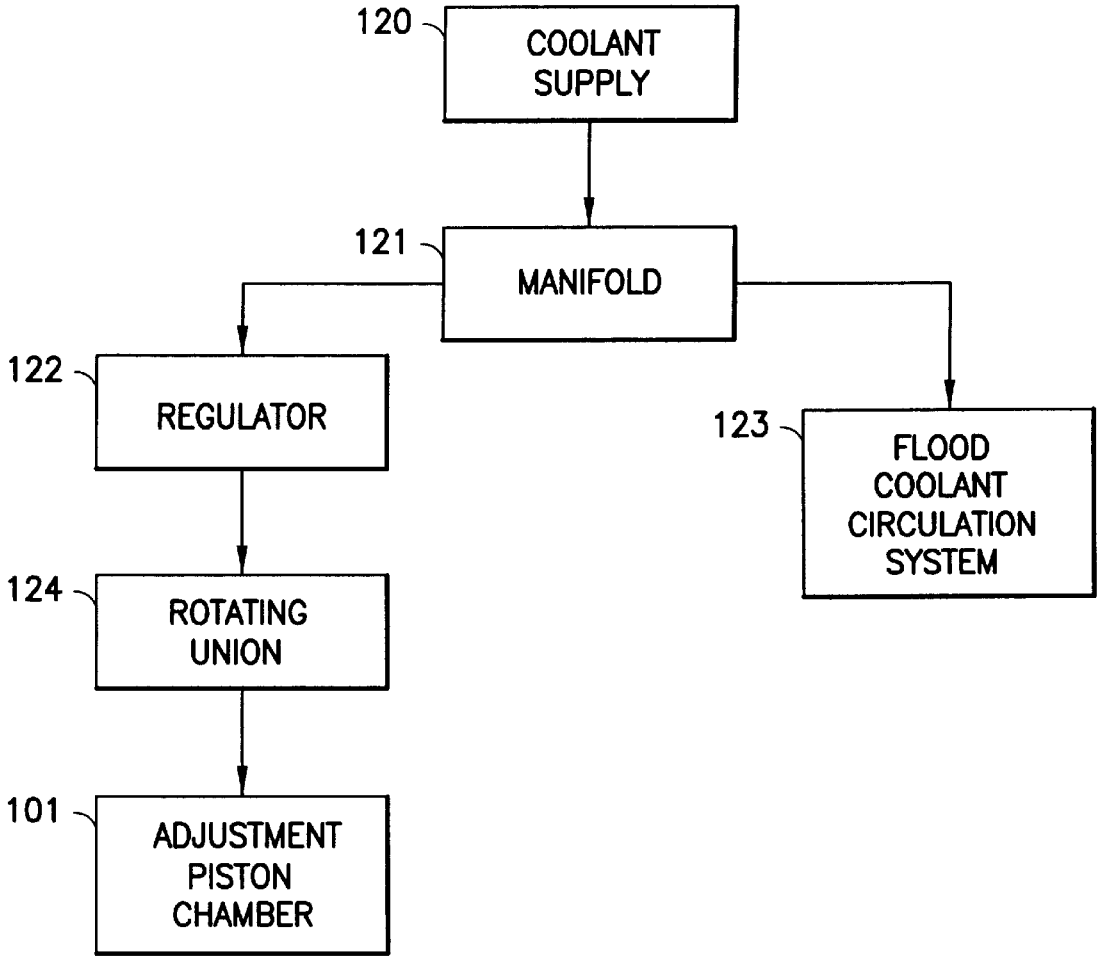
FIG. 2 is a block diagram of the fluid system of this invention.
Figure 3:
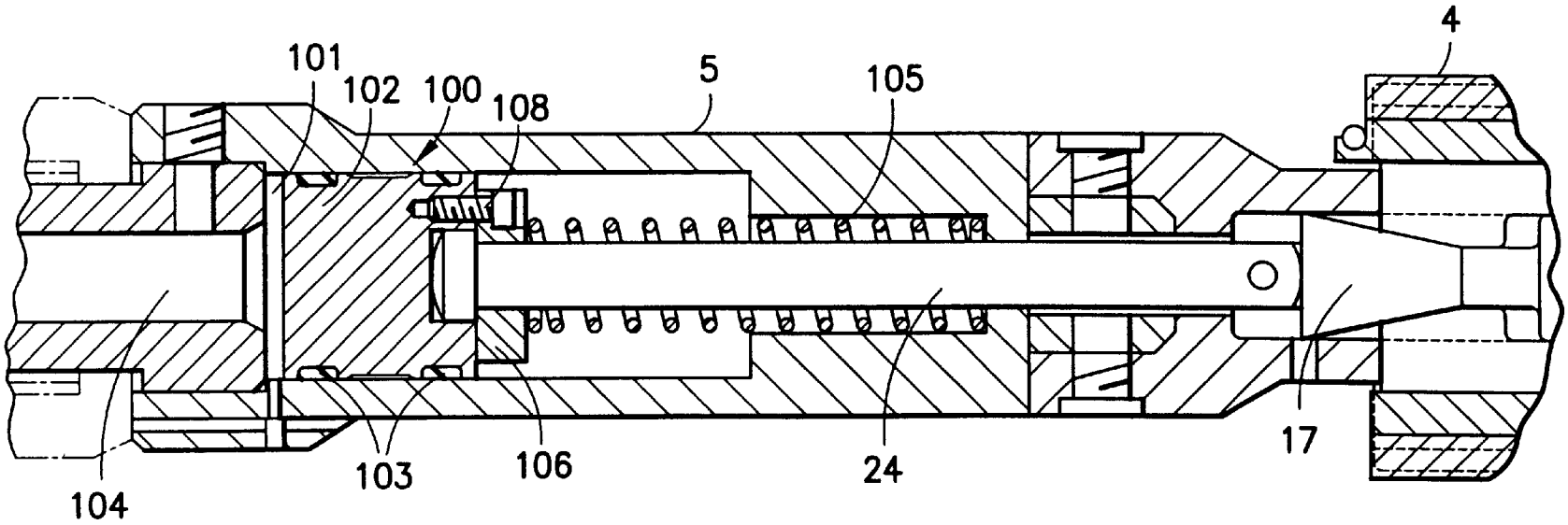
FIG. 3 is an enlarged view of the fluid adjustment mechanism of this invention.

As shown best in FIGS. 1–3, a honing tool is connected to the spindle of a CNC machine by means of a shank adapter 107. Adjustment rod 24 is mounted for axial movement within mandrel 5. A fluid chamber 101 is constructed at the spindle end of mandrel 5. The spindle end 100 of adjustment rod 24 extends into the fluid chamber 101 and is connected to a piston 102, which is coextensive in diameter to the chamber 101. Fluid pressure within chamber 101 acts on the upper surface of piston 102. The piston 102 includes sealing rings 103 to engage the inner walls of the chamber 101 in a sealing relation. Piston 102 is free to move within the chamber and such movement provides the adjustment motion for adjustment rod 24, as described above. A spring 105 is operatively connected to adjustment rod 24 to urge the rod 24 towards the spindle end of the mandrel 5.

A supply of coolant fluid is connected to the chamber 101 through channel 104, which is in turn connected through the spindle of the CNC machine. The pressure of coolant fluid exerts a downward force on the piston 102 against the bias force of spring 105. This force is designed to exert a continuous force on the piston 102, which tends to expand the abrasive elements. Piston 102 may be attached to the adjustment rod 24 by means of a washer 106 secured to piston 102 by screws 108. An expanded head 100 is constructed on the end of the rod 24 to provide a surface to engage the washer 106 and clamp rod 24 to piston 102. This arrangement provides a simple mechanism for adjusting the position of the abrasive elements 22.

A typical coolant supply system used with CNC machines is shown in FIG. 2. The coolant supply reservoir 120 is connected through a manifold 121 to multiple delivery channels. Generally at least one of these channels supplies coolant to a flood coolant circulation system 123, which is designed to flood the workpiece with coolant, as an operation is being performed. Another channel directs fluid from the spindle through a rotating union 124, which allows the passage of fluid from a stationary part on the spindle to a rotating part on the tool. In this instance it is used to supply coolant fluid to the adjustment piston chamber 101. As there is less need in a honing operation to provide through the spindle coolant, this channel is available for other purposes and may be used to supply the chamber 101. A honing operation generally relies on flood coolant to lubricate and cool the tool/workpiece interface. In order to adjust the pressure for use as an adjustment medium according to this invention, it may be advantageous to insert a pressure regulator 122 upstream of the rotating union for this application.

We claim:

1. In a machine for removing material from a workpiece using abrasive elements in a tool assembly, said tool assembly being releasably attached to a driven spindle, a method for adjusting the abrasive elements comprising the steps of:

supplying fluid under pressure to said spindle and adapting said spindle to provide a fluid supply to the tool assembly;

mounting said abrasive elements within channels of said tool assembly for radial movement therein;

engaging said abrasive elements with an adjustment assembly mounted within the tool assembly to convert an axial force to a radial force to actuate said radial movement of the abrasive elements;

forming a chamber in the tool assembly; and connecting said fluid supply to said chamber to provide pressurized fluid thereto, wherein said fluid acts on said adjustment assembly to exert an axial force thereon to adjust the position of said abrasive elements; wherein said step of connecting said fluid supply further comprises the steps of:

constructing a manifold to receive coolant fluid and distribute fluid to a flood coolant circulation system of said machine;

connecting a channel to divert a predetermined amount of coolant fluid from said manifold to said spindle and said abrasive assembly; and connecting said chamber to receive said diverted fluid.

2. In a machine for removing material from a workpiece using abrasive elements in a tool assembly, said tool assembly being releasably attached to a driven spindle, a method for adjusting the abrasive elements, according to claim 1, further comprising the steps of:

connecting an adjustment rod to said adjustment assembly to apply said axial force to said adjustment assembly;

mounting a piston for axial movement in said chamber and attaching said piston to said adjustment rod for axial movement therewith, wherein said fluid in chamber acts on said piston.

3. In a machine for removing material from a workpiece using abrasive elements in a tool assembly, said tool assembly being releasably attached to a driven spindle, a method for adjusting the abrasive elements, according to claim 1, wherein the step of diverting a predetermined amount of coolant fluid is accomplished by means of a regulator.

4. A tool assembly for use on a machine, said machine having a drive spindle for connection to said tool assembly and a fluid supply connected to said spindle, said tool assembly comprising:

a housing having a passage extending its length, said housing adapted for connection to said spindle for rotation therewith and extending to a distal end;

a plurality of abrasive elements mounted within channels of a tool body for radial movement with respect to the tool body, said tool body mounted on said distal end;

an adjustment assembly mounted within said housing in engagement with said abrasive elements to convert an axial force to a radial force to actuate said radial movement of the abrasive elements;

a chamber formed in said housing; and a fluid connection, connected to said fluid supply, for supplying fluid under pressure to said chamber, wherein said fluid acts on said adjustment assembly to exert an axial force thereon;

said tool assembly further comprising:

an adjustment rod mounted within said housing and connected to said adjustment assembly to apply said axial force to said adjustment assembly; and a piston mounted for axial movement in said chamber and attached to said adjustment rod for axial movement therewith, wherein said fluid acts on said piston to provide axial movement thereof, wherein a spring is positioned in the housing to engage the piston and urge said piston towards said spindle; and wherein the fluid supply pressure is predetermined to exert a force on the piston to offset the force of the spring and to provide a consistent force on the piston towards the distal end of the housing.

5. A tool assembly for use on a machine, as described in claim 1, wherein the source of fluid comprises coolant fluid supplied to the machine to provide flood cooling during operation of the machine.

6. A tool assembly for use on a machine, as described in claim 5, wherein the fluid supply is adapted to divert a predetermined amount of fluid from said source of coolant fluid.

7. A tool assembly for use on a machine, as described in claim 6, wherein the source of fluid further comprises:

a manifold constructed to receive the coolant fluid and distribute fluid to a flood coolant circulation system;

a regulator connected to said manifold to divert an amount of coolant fluid from said manifold to a rotary union between said spindle and said housing; and a fluid passage constructed in said housing to direct said diverted fluid to said chamber.

8. A machine for removing material from workpiece using an abrasive tool assembly comprising:

a driven spindle for receiving said abrasive tool;

a source of coolant fluid connected to said spindle and adapt to provide a coolant fluid supply to the tool assembly;

wherein said tool assembly further comprises:

a housing having a passage extending its length, said housing adapted for connection to said spindle for rotation therewith and extending to a distal end;

a plurality of abrasive elements mounted within channels of a tool body for radial movement with respect to the tool body, said tool body mounted on said housing at the distal end;

an adjustment assembly mounted within said housing in engagement with said abrasive elements to convert an axial force to a radial force and to actuate said radial movement of the abrasive elements;

a chamber formed in said housing; and a fluid connection to supply fluid under pressure to said chamber, wherein said fluid acts on said adjustment assembly to exert an axial force thereon;

the source of fluid further comprising:

a manifold constructed to receive coolant fluid and distribute fluid to a flood coolant circulation system;

a regulator connected to said manifold to divert an amount of coolant fluid from said manifold to a rotary union between said spindle and said housing; and a fluid passage constructed in said housing to direct said diverted fluid to said chamber.

9. A machine for removing material from a workpiece using an abrasive tool assembly, as described in claim 8, further comprising:

an adjustment rod mounted within said housing and connected to said adjustment assembly to apply said axial force to said adjustment assembly; and a piston mounted for axial movement in said chamber and attached to said adjustment rod for axial movement therewith, wherein said fluid acts on said piston to provide axial movement thereof.

* * * * *